US007114781B2

(12) United States Patent
Costaglia

(10) Patent No.: US 7,114,781 B2
(45) Date of Patent: Oct. 3, 2006

(54) OFFICE CHAIR WITH HIGH-TECHNOLOGY ARMREST EQUIPPED WITH INTEGRATED CONTROL BUTTONS FOR ADJUSTING THE MOVEMENTS OF THE SEAT AND THE SEAT BACK

(75) Inventor: Massimo Costaglia, Galliera Veneta (IT)

(73) Assignee: Metalseat SrL, Galliera Veneta (IT)

( * ) Notice: Subject to any disclaimer, the term of this patent is extended or adjusted under 35 U.S.C. 154(b) by 0 days.

(21) Appl. No.: 10/742,368

(22) Filed: Dec. 19, 2003

(65) Prior Publication Data

US 2004/0135418 A1 Jul. 15, 2004

(30) Foreign Application Priority Data

Dec. 20, 2002 (IT) ..... TV2002A0157

(51) Int. Cl.
*A47C 7/54* (2006.01)

(52) U.S. Cl. ..... 297/411.2; 297/463.1; 297/313; 297/340; 297/354.12

(58) Field of Classification Search ..... 297/411.24, 297/411.2, 354.1, 463.1, 313, 340, 354.12
See application file for complete search history.

(56) References Cited

U.S. PATENT DOCUMENTS

| | | | | | |
|---|---|---|---|---|---|
| 2,863,494 | A | * | 12/1958 | Lautier et al. | 297/362.12 |
| 3,368,845 | A | * | 2/1968 | Watanabe | 297/330 |
| 3,744,843 | A | * | 7/1973 | Barecki et al. | 297/316 |
| 3,778,103 | A | * | 12/1973 | Edwards | 297/331 |
| 4,674,713 | A | * | 6/1987 | Ryan et al. | 244/122 R |
| 4,966,413 | A | * | 10/1990 | Palarski | 297/330 |
| 4,986,601 | A | | 1/1991 | Inoue | |
| 5,090,770 | A | * | 2/1992 | Heinrichs et al. | 297/344.19 |
| 5,566,778 | A | * | 10/1996 | Valier et al. | 180/334 |
| 5,671,972 | A | * | 9/1997 | Tedesco | 297/362.13 |
| 5,795,026 | A | * | 8/1998 | Dral et al. | 297/411.36 |
| 5,921,630 | A | | 7/1999 | Cassaday | |
| 6,019,429 | A | | 2/2000 | Tedesco | |
| 6,416,131 | B1 | * | 7/2002 | Changkeun | 297/344.19 |
| 6,669,292 | B1 | * | 12/2003 | Koepke et al. | 297/300.2 |

FOREIGN PATENT DOCUMENTS

| | | |
|---|---|---|
| EP | 0198056 | 5/1986 |
| EP | 0329455 | 8/1989 |
| FR | 2075176 | 10/1971 |

* cited by examiner

*Primary Examiner*—Peter M. Cuomo
*Assistant Examiner*—Joseph Edell
(74) *Attorney, Agent, or Firm*—Egbert Law Offices

(57) ABSTRACT

A high-technology armrest with integrated buttons connected to a command transmission cable for the adjustment of the seat and the seat back movements of an office chair with articulations for the synchronized movement of the seat plane and the seat back. The invention includes a mobile base of the "rocket launcher" type, from which base a column rises, which is adjustable in height, and which supports the seat plane and the reciprocally hinged seat back.

A first armrest of the office chair is equipped near the front end with two side-by-side buttons.

A second armrest of the office chair, designed symmetrically to the first, is equipped near the front end with a single-control button, for the function of adjusting the height of the chair.

5 Claims, 6 Drawing Sheets

OFFICE CHAIR WITH HIGH-TECHNOLOGY ARMREST EQUIPPED WITH INTEGRATED CONTROL BUTTONS FOR ADJUSTING THE MOVEMENTS OF THE SEAT AND THE SEAT BACK

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The subject of the present invention is an office chair with a high-technology armrest equipped with integrated control buttons for adjusting the movements of the seat and the seat back, and more specifically the inclination of the seat plane and the seat back, as well as the height of the seating position.

The proposal finds a particular, but not exclusive, application in the sector of quality chairs for office furnishings.

BACKGROUND OF THE INVENTION

Adjustable office seats and chairs are certainly well-known. To enable a more comfortable seating position than lower-priced models, which are usually fixed, they incorporate, in addition to a device for adjusting the height of the seat, the use of a device for the controlled swinging of the seat back, generally located in the part immediately beneath the seat plane and integral to it. This device is primarily activated via a protruding lever that can easily be gripped and therefore rotated in one direction or another, until the internal mechanism releases the articulation.

In short, it is therefore possible to maintain that the following are known:

1. chairs in which the seat and the seat back are designed with separate body shells, which are connected in such a way that an inclination of the seat back corresponds to a parallel downward movement of the seat plane;
2. chairs in which only the seat back is freely swinging;
3. chairs in which the raising of the seat plane corresponds to the inclination of the seat back;
4. chairs in which both the seat and the seat back are individually adjustable;
5. finally, seats in which both the seat plane and the seat back, which are interconnected, perform a synchronized swinging movement.

PRIOR ART

By way of an example, a first dynamic device for chairs is described in FR2075176 (Suspa), involving a base equipped with a number of support arms, from which an upright rises, composed of a gas cylinder. The end of said gas cylinder, from which the activation button of the piston protrudes, is inserted inside a hole in the shape of a truncated cone, extracted monolithically from the containing box structure of the device.

More significant is U.S. Pat. No. 4,986,601 (Inoue), which mentions the swinging mechanism to support a seat and the seat back of a chair, consisting of a central column that extends from the base of the chair, a first support clamp connected to the central column by means of a pedestal, a second support clamp connected to the chair and hinged to the first support clamp by means of a shaft, a third support clamp connected to the rear support and hinged by means of a shaft to the second support clamp, and a shaft that hinges the first support clamp to the third support clamp. U.S. Pat. No. 4,986,601 (Inoue) also provides for a gas piston with a valve that can be actuated by a rod in the central column to selectively adjust the height of the column. Finally, U.S. Pat. No. 4,986,601 (Inoue) also provides for spring mechanisms to exert an opposing force on the second support clamp, positioned between the first and second clamps.

DE0198056 (Neumuller) is of interest. This is a swinging mechanism to support the seat plane and the seat back of a chair, consisting of a central column that extends from the base of the chair, a first support clamp connected to the central column, a second support clamp connected to the seat plane and pivoted to the first clamp by a first pin, a third support clamp connected to the seat back and hinged to the second support clamp by a second pin, in addition to a mechanism that pivots the first support clamp to the third support clamp. DE0198056 (Neumuller) also provides for spring mechanisms positioned between the first and second support clamps, to exert an opposing force to the movement of the second clamp. DE0198056 (Neumuller) also provides for locking mechanisms, consisting of a third pin connected to the first clamp and a fourth pin connected to the second clamp, working together with a number of disks equipped with an elongated slot through which the pin passes. A rod associated with the respective pin provides the friction anchoring of the disks, which are thus held together.

U.S. Pat. No. 5,921,630 (Cassaday) is a conventional example of how the control devices for the various adjustment functions of the seat are typically positioned underneath the seat plane.

These traditional solutions may finally be complemented by others which are less popular but more recent. In short, they can be understood as providing for a button for locking/release the height of the seat plane, which is usually located along the side of the chair, appearing towards the outside and at the side of the seat plane. In this case, the button, by means of a small cable integrated along the side of the chair, at the side of the seat plane, is brought close to the top of the gas column, where it interacts with an accessory enabling the height adjustment device to be activated.

Ultimately, it is possible to state, in summary, that adjustment devices are known which include:

1. a first lever arm, positioned underneath the seat plane, one end of which constitutes the handle, while the other end, pivoted to the support structure of the seat plane, activates the height adjustment device provided at the top of the small column;
2. a second lever arm, always positioned underneath the seat plane, on the opposite side or the same side as the first, one end of which constitutes the handle, while the other end is interconnected with a locking/release device for the swinging function or synchronized movement function of the seat and the seat back;
3. a button, constituting an alternative to the first lever, positioned along the side of the seat plane, sometimes at the side of the body shell, which, by means of a small flexible cable, activates the height adjustment device provided at the top of the small column.

PRIOR ART CONCERNING THE INVENTION

EP0329455 (Aero) proposes a device to adjust the inclination and lock the back of a chair. In more detailed terms, this is a push-button device positioned along the external side and at the end of one of the two arms of an aircraft seat. Said button controls the running of a cable arranged coaxially to a sheath, integrated into the arm and extending along the same towards the back until it reaches the termination underneath the seat plane, where an actuator device is positioned. Said actuator device is composed of a cylinder which, on one side, provides the activation button stimulated by means of a set of levers, from the small cable connected to the button and, from the other side, activates, via the shaft, a movement arm controlled by the seat back.

U.S. Pat. No. 6,019,429 (Global) proposes a control device for a chair for office use. In this specific case, it is a question of at least one control button integrated into the arm of a chair, and more specifically located directly underneath the support plane afforded by the same arm, along the side and appearing towards the inside of the seat. In this hypothesis, the button is inserted coaxially to a support, consisting of a cylindrical guide body that can be implemented in the structure of the arm. Even more specifically, said support provides for the protrusion, on one side, of the button, which remains external with respect to the arm, and on the other side (internally to the arm), by means of a fork arrangement, locks, with the lower part of the same, the end of the sheath, from which the respective control cable emerges. The end of said control cable is implemented next to one end of an overhanging lever with an "L" arrangement. This lever is in turn pivoted, sideways on, to the upper part of the fork, a little above the lower one. It usually consists of a pre-tensioned cable, which, by means of the lever, ensures that the button always protrudes towards the outside, enabling the user to activate the adjustment device by means of exerting a light pressure on the same, in such a way as to cause the swinging of the lever in an upward direction, which therefore subsequently pulls the control cable. To permit the activation of the cylinder, which in this case always controls the single function of locking/releasing the back, the other end of the flexible cable also uses a lever, which is pivoted, with a spring-back mechanism, at the side of the activation button located next to said movement cylinder of the back. In this way, with the button in the depressed position, the lever pivoted to the movement cylinder is brought considerably closer to the base that holds the end of the sheath, with the result that, by means of a denticle, the latter exerts a force on the activation button, thus controlling the exit of the shaft.

DISADVANTAGES

In summary, both U.S. Pat. No. 4,986,601 (Inoue) and DE0198056 (Neumuller), which provide for synchronized movements of the seat or seat back, possess a system of mechanical linkage, locking/release, positioned underneath the seat plane. Said device, conventionally used both for the inclination adjustment function of the seat plane and the seat back, and to preset the height of the seat, has the disadvantage that is also shared by other solutions, such as U.S. Pat. No. 5,921,630 (Cassaday), of particularly inconvenient access to the handles at the end of the respective adjustment levers. From the practical viewpoint, it is necessary that the user, after sitting down, must lean to either one side or the other, straining to stretch the arms to the area under the seat containing the levers. Quite apart from the objective difficulty of identify it, due to the fact that, once seated, it is impossible to locate it, since it is hidden by the seat plane above, there is the objective danger of accidents. The excessive free movement of the hands underneath the seat plane, intent on the usual searching operations, it can occur that the ends of the fingers can slip into areas of the swinging device which are very dangerous. The presence of articulated arms, sharp areas, and mechanical parts in motion, which are not adequately protected, is certainly one of the causes of frequent accidents.

In EP0329455 (Aero) as in U.S. Pat. No. 6,019,429 (Global), the main disadvantage is associated with the position of the button. Indeed, in both the former and the latter, the position of the lock/release button is along the side of the same armrest, and in one case along the external side, and in the other case along the internal side. However, both designs do not permit easy identification, which requires the fingers to touch the side of the armrest in an exploratory way so as to search for the respective control button. The inconvenient position of the fingers, during the searching, is also required due to the fact that the palm of the hand must always remain supported along the upper side of the armrest, and in such a way as to exert the appropriate force required to overcome the resistance of the button.

Another significant disadvantage, in the case of both EP0329455 (Aero) and U.S. Pat. No. 6,019,429 (Global), is the fact that the control button located along the armrest, since it has only a single control, is of the type capable of performing a dual function. In more detail, each button illustrated has two positions, the first a rest position or static condition, which permits the locking of the seat plane or seat back in the desired position, and a second dynamic or depressed position, during which, due to the fact that the button activates the actuator device, it permits the inclination of the seat plane or seat back until it reaches the desired position, whereupon the button is finally released and the movement is therefore locked. The fact of providing the single-control adjustment button may, from a practical viewpoint, confuse the user about the desired function, in the sense that the user, by pressing the button, is not capable of knowing exactly what function is activated at any given time. This feeling of uncertainty persuades the user to preventively check the activated function by means of the concomitant body movement, which consequently involves greater work for the structure, an excessive strain on the articulations of the chair due to the fact that a normal force is not usually exerted, but rather one tends to increase the intensity of application when it comes to performing a check.

Yet another disadvantage, applicable to both EP0329455 (Aero) and U.S. Pat. No. 6,019,429 (Global) concerns the fact that the buttons, positioned along the external or internal side of the armrest, are particularly prone to accidental contact. In fact, it may happen that an unusual movement, for example of the legs or arm, may bump by chance against the surface of the button, unexpectedly activating the release function. Quite apart from the surprise or shock engendered in the user, the main disadvantage is an excessive strain on the structure and mechanical parts, which increases wear and tear even to the extent of causing the possible breakage of certain parts.

BRIEF SUMMARY OF THE INVENTION

This and other purposes are fulfilled by the present innovation, according to the characteristics of which in the annexed claims, it solves the problems indicated above by means of a high-technology armrest with integrated buttons connected to a command transmission cable for the adjustment of the seat and the seat back movements of an office chair with articulations for the synchronized movement of the seat plane and the seat back, comprising a mobile base of the "rocket launcher" type, from which base a column rises, which is adjustable in height, and which supports the seat plane and the reciprocally hinged seat back, whereby:

a first armrest of the office chair is equipped near the front end with two side-by-side buttons, of which a first button performs the function of releasing the movement of the seat plan and the inclination of the seat back, and a second button, adjacent to the first, activates the locking function of the seat plane and the inclination of the seat back;

a second armrest of the office chair, designed symmetrically to the first, which is equipped near the front end with a single-control button, for the function of adjusting the height of the chair.

PURPOSES

In this way, by means of the notable creative contribution, the effect of which constitutes an immediate technological advance, certain objectives are achieved, all substantially geared to permitting the optimal use of the seat adjustment control devices integrated into the armrests.

The principal purpose consists of improving the positioning of the control buttons. From a practical viewpoint, the fact of positioning the buttons near to the edge, at the front end of the armrest, has the merit of preventing the same from being depressed accidentally, which would activate undesired and therefore unexpected functions.

A second purpose is that of making the buttons constantly visible. In this way, no effort is required of the user for the purpose of searching for the buttons along the armrest, which ultimately makes the buttons readily available.

A third purpose concerns the fact of maximizing the ease of reaching the position of the control buttons with the fingers of the hand in a normal position. This concerns achieving the greatest convenience, and especially due to the fact that it is performed vertically, means that only a small force needs to be applied to the buttons to cause the activation of the required function.

A fourth purpose is that of permitting the user to easily distinguish between the desired functions, by dividing in two the lock/release command for the movement of the seat plane and the inclination of the seat back.

Finally, a further intended purpose is to permit the maintenance in a possible locked condition of the movement of the seat plane and the inclination of the seat back.

Ultimately, a seat structure can be created having with good technological input, which integrates as many functions as possible, which can be offered to the public at a reasonably low cost.

This and other advantages will be discussed in the following detailed description of at least one preferential solution for the implementation with the aid of the annexed schematic diagrams, the specifics of the execution of which are not intended to be restrictive, but only exemplary.

DETAILED DESCRIPTION OF THE INVENTION

Figure 1:
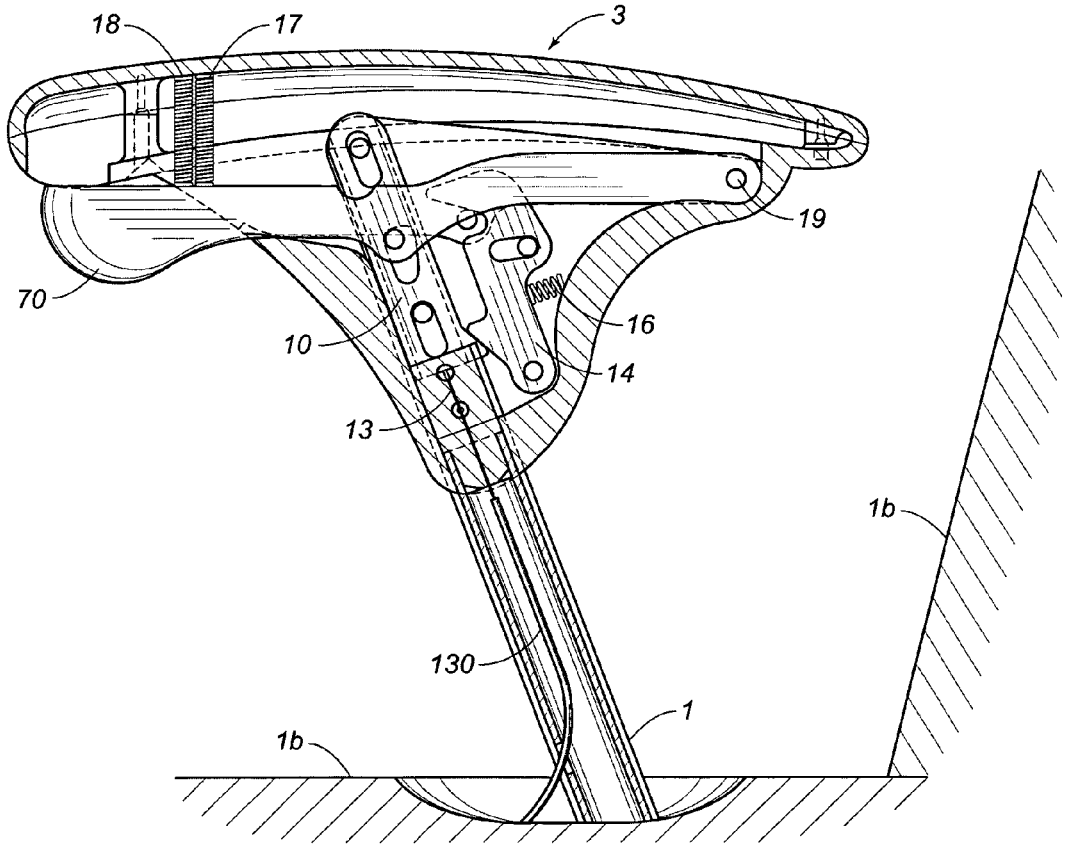
FIG. 1 is a view of the longitudinal section of the armrest, which possesses two buttons for the locking/release of the movement of the seat plane and the inclination of the seat back, shown in the resting condition.
Figure 2:
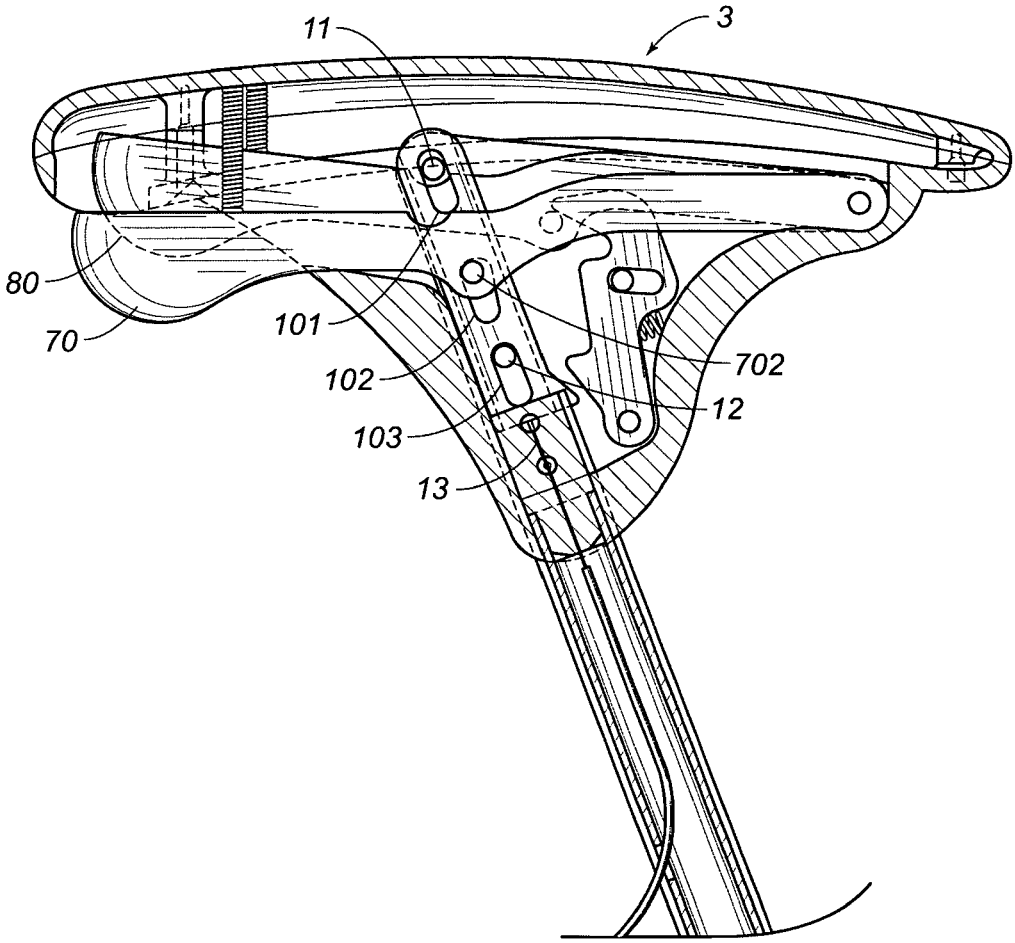
FIG. 2 is another view of the longitudinal section of the armrest of FIG. 1, with the locking button activated, which moves the retaining cog, which is not yet engaged.
Figure 3:
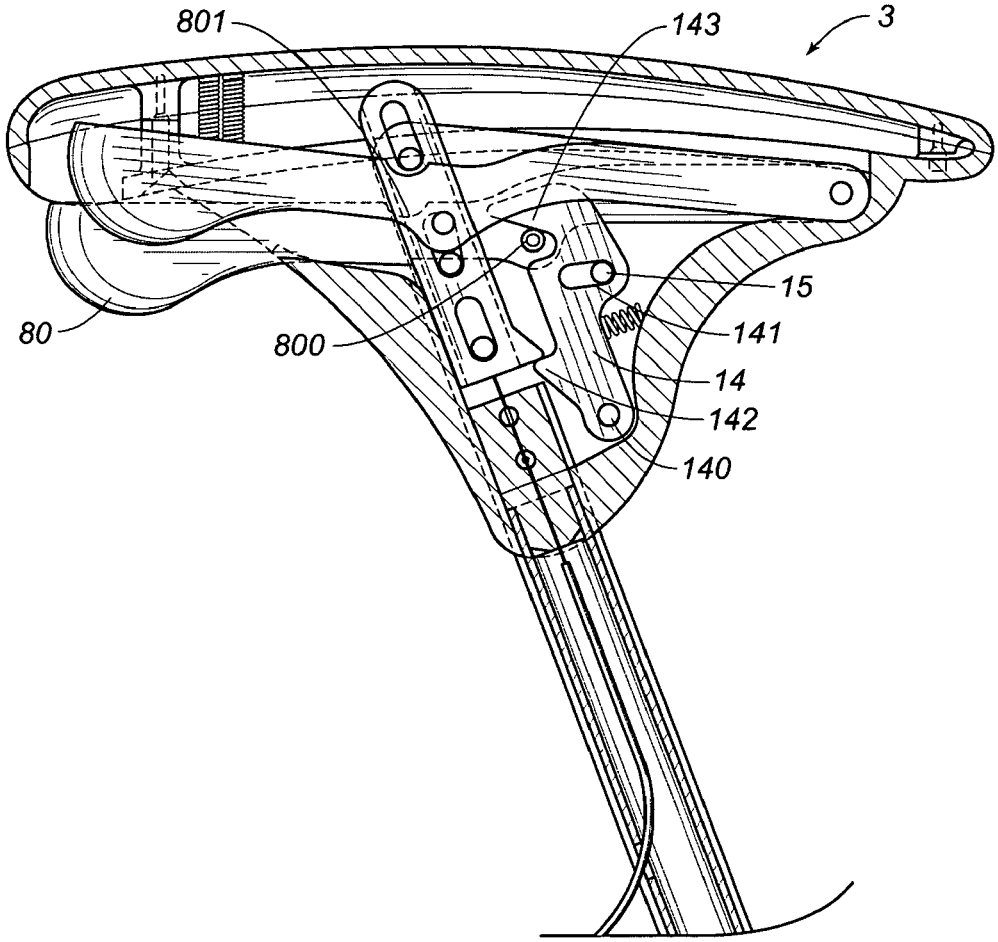
FIG. 3 is another view of the longitudinal section of the armrest of FIG. 1, with the locking button activated, shown with the retaining cog in the engaged condition.
Figure 4:
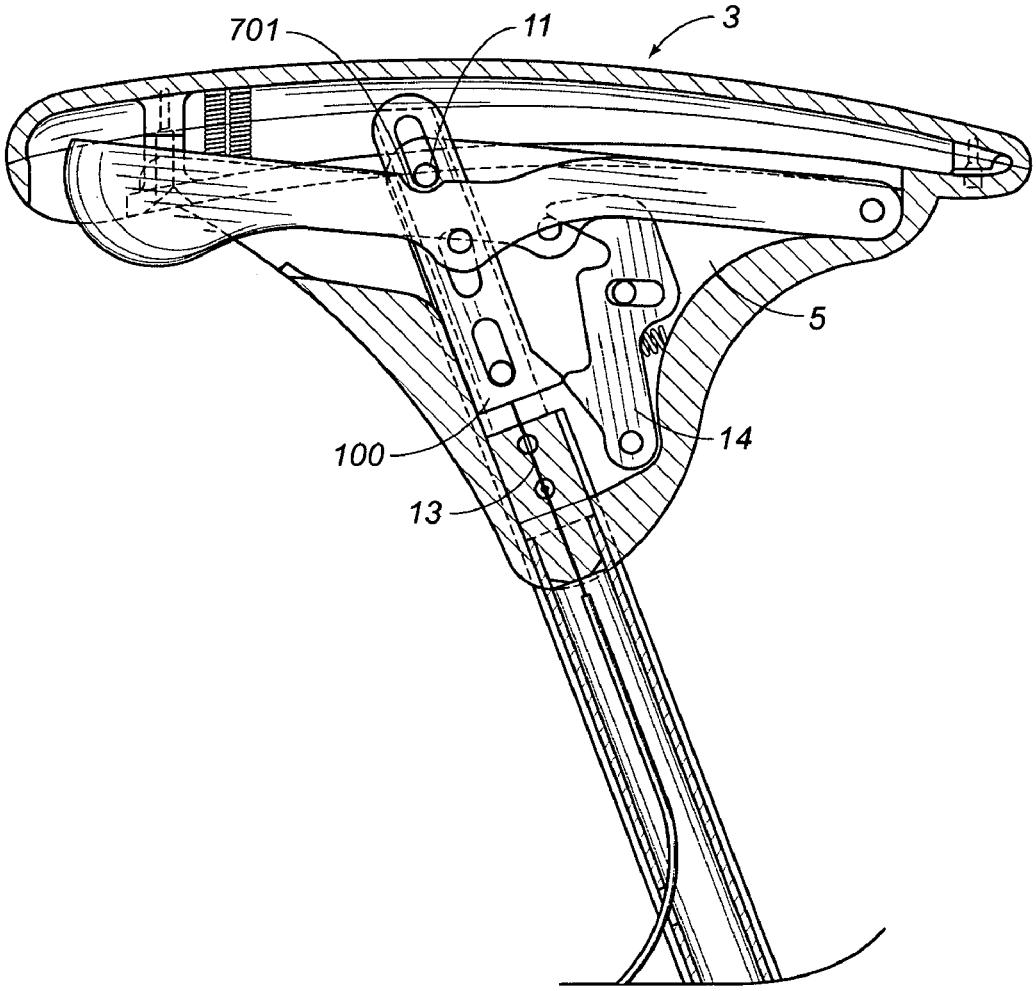
FIG. 4 is another view of the longitudinal section of the armrest of FIG. 1, with the release button activated, shown with the retaining cog in the disengaged condition.
Figure 5:
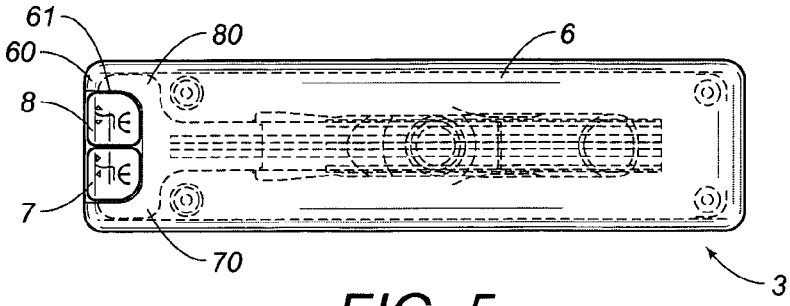
FIG. 5 is top plan view of the armrest which includes the locking/release buttons for moving the seat plane and the inclination of the seat back.
Figure 6:
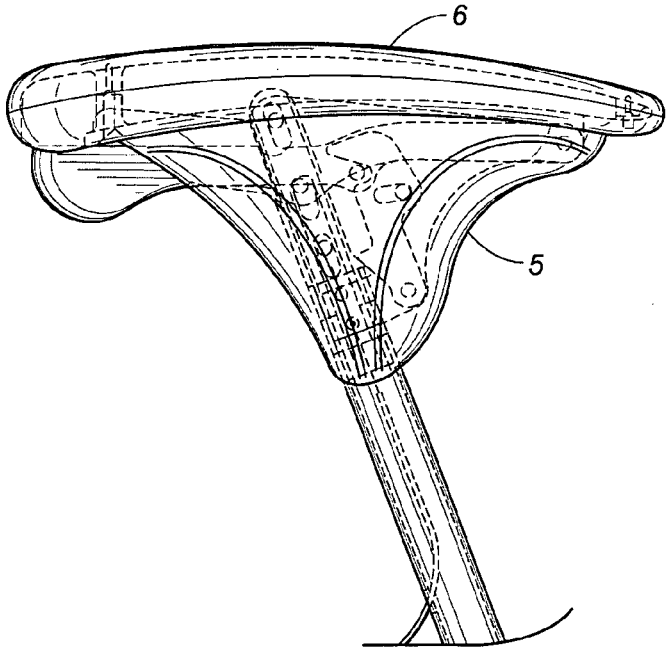
FIG. 6 is a side view of the armrest in the preceding FIG. 5.
Figure 7:
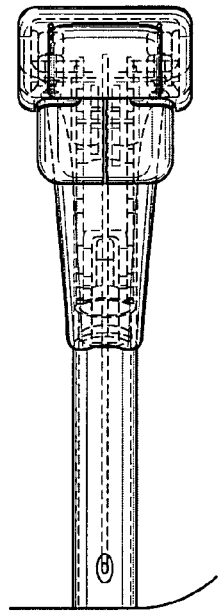
FIG. 7 is a front elevation view of the armrest in FIG. 5.
Figure 8:
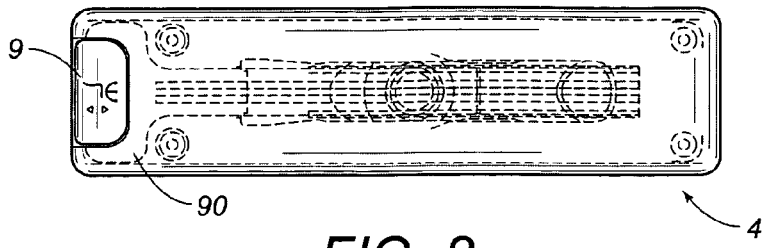
FIG. 8 is a top plan view of the armrest which includes the single-control button for adjusting the height of the chair.
Figure 9:
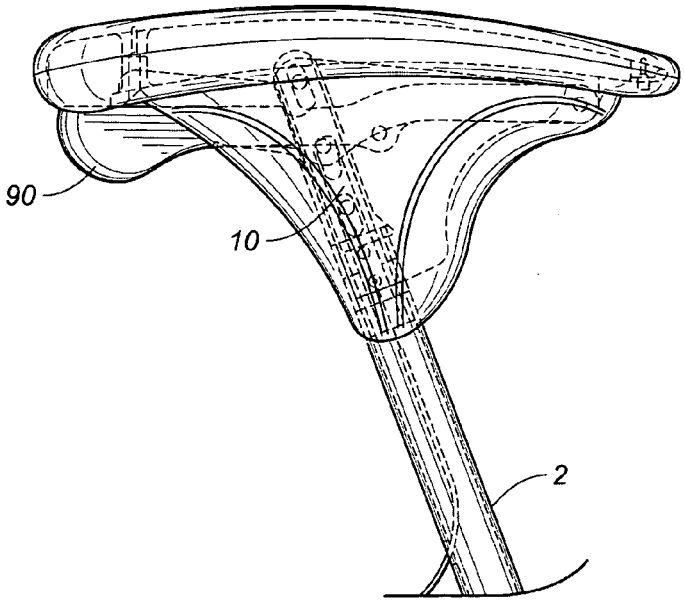
FIG. 9 is a side view of the armrest in the preceding FIG. 8.
Figure 10:
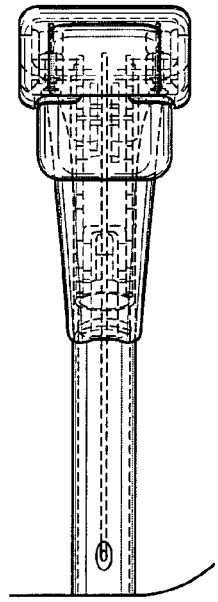
FIG. 10 is a front elevation view of the armrest in FIG. 8.

Taking the figures as a reference, it is observed that the structure of an office chair is composed of a base that supports a seat plane and a seat back above, and these last two are reciprocally implemented, one on the other. Between the base and the articulated assembly of the seat plane and the seat back above, there is a vertical column, mostly composed of a gas cylinder, with a conventional activation button located near the upper end, which allows the adjustment of the height of the seat. Finally, as regards the structure of the chair, it is noted that under the corresponding seat plane there is a locking/release device for the articulated assembly of the seat plane and the seat back above.

In more detail, along each of the two sides, on the right and left sides respectively of the seat plane 1*a* of the office chair, there rises a corresponding tubular upright, 1 and 2, slightly inclined towards the front part. The upper part of said upright, 1 and 2, incorporates an armrest 3 and 4, which possesses a sheathed static support structure 5, substantially closed to wrap around the lower end part of the corresponding tubular upright 1 and 2 and with a surface drawn along the upper side of the armrest 3 and 4, which functions as a base plane 6 for the respective forearm, essentially flat but slightly curved. Said base plane 6 of each of the two armrests 3 and 4, possesses, next to the front side 60, a recess 61 inside of which is housed at least one button 7, 8 or 9. In this case, while the buttons 7, 8 provided next to the armrest 3 constitute the controls for locking 7 and releasing 8 the swinging movement of the articulated assembly of the seat plane 1*a* and the seat back 1*b*, the single-control button 9, located on the armrest 4, permits the height adjustment of the seat, which comprises the articulated assembly of the seat plane 1*a* and the seat back 1*b*.

In even more detail, the buttons 7 and 8 act at the end of two levers 70 and 80, which are side by side and interdependent on each other, both located inside the sheathing structure 5 of the armrest 3. Said levers 70 and 80 are, from the other side, pivoted with a pin 19 towards the rear part of the armrest 3, thus permitting the swinging, controlled by the springs 17 and 18, of the only front part of the levers 70 and 80. A first lever 70 acts to lock the swinging device of the articulated assembly of the seat plane and the seat back.

This is located behind one side of the stay rod 10, and the stay rod 10 is composed of a flat element which moves to and fro axially with respect to the tubular part of the upright 1 which supports the armrest 3. The stay rod 10 is substantially composed of a metal strip with a series of holes resembling buttonholes 101, 102 and 103 spaced out along it. The first hole 101 has the function, by means of the fixation bar 11 of linking the upper end of the stay rod 10, and simultaneously, via the guide hole 101, permits axial movement, linked in the course of the length of the same. In addition, said fixation bar 11, passing right through the stay rod 10 and used with the ends in the static support structure 5, constitutes at the same time the locking component for the end of the motion of the levers 70 and 80. In the case in question, these are supplied along the upper edge of a respective housing 701, 801 inside of which the affected part of the stroke of the fixation bar 11 is partially housed. In the part directly above the guide hole 101, a second guide hole 102 is present, inside of which a cog 702 is inserted, drawn sideways and integral with the lever 70. Finally, the third hole 103 above the hole 102 permits the use of a second fixation bar 12 which serves the purpose of permitting the stay rod 10 to be kept in the axial guide.

Next to the base 100 of the stay rod 10 is the end of a flexible cable 13 which, together with the respective sheath 130 is made to run inside the tubular upright 1. In the solution shown, the end of the sheath 130 is inserted near the entrance of the tubular upright 1 into the armrest 3, in such a way that, inside the armrest, the single flexible cable 13 is extended with the respective end.

At the back of the stay rod 10, still inside the armrest 3, there is a space in the internal layout of the same armrest, which accommodates a lever 14. Said lever 14, which interacts with the stay rod 10, is pivoted in its lower part to a fixation pin 140, which is an integral part of the static structure of the armrest, permitting the upper part to swing forwards and backwards. This movement is controlled by means of a guide hole 141 in an intermediate position, linked by means of a guide pin 15 to the static structure of the armrest. A spring 16 is positioned behind the lever 14 and with the respective ends exerts a force on one side against the same lever 14, and on the other side against the internal surface of the static structure of the armrest. Along the front profile of the lever 14, there is a cog 142, the shape of which includes an inclined plane followed by a leveling table. In the case in question, along the rear side of the stay rod 10 which faces towards the lever 14, there is a counter-shaped profile corresponding to the cog 142, formed in such a way that the two opposing inclined planes can create a guide surface for the sliding movement, causing the lever 14 to move backwards, and consequently, due to the spring-back effect produced by the spring 16, to be pushed forwards again to intercept the lower cog that projects near the end 100.

As regards the upper part of the lever 14, it is shaped like a spout 143 with an undercut housing 144. The profile of the shape 143 defines the route of the guide pin 800 drawn sideways to the lever 80 and with which it interferes, consequently determining the movement of the lever 14. In more detail, by pressing the button 8 with the release function, the respective guide pin 800 stress the spout-shaped profile 143 of the lever 14, determining the movement of the part including the retaining cog 142 of the cog near the end 100 of the stay rod 10.

Both the lever 70 and the lever 80 possess a spring 17 and 18, each of which exerts a force with its own lower end along the upper side of the corresponding lever 70, 80, while the upper end of each exerts a force on the static support structure of the armrest 3. Both the locking button 7 and the release button 8 are brought back into their resting position, all the way down, by the abovementioned springs 17 and 18.

In operational terms, by pressing the locking button 7 connected to the lever 70, the rotation of the same lever around the fulcrum 19 occurs. Attached to the stay rod 10 is the end of the steel cable 13 which activates the locking pin of the chair. When the locking button 7 is pressed, an upward movement of the stay rod 10 occurs, which is coupled with, and held in its stop position by, the retaining cog 142, 14. In this way, the desired situation of traction of the steel cable 13 is determined, even if the button 7 is released. This technical feature determines the function of automatic searching for the lock position, that is to say, the device automatically finds the lock without the user maintaining pressure on the button 7. To obtain the release of the mechanism, the adjacent button 8 is activated, which, by means of the corresponding and connected lever 80, causes the rotation of the retaining cog 14, 142, until the release of the stay rod 10 is obtained. Once the stay rod 10 has been released, the retaining cog 14, 142 turns with force towards the stay rod 10 as a result of the spring 16.

As regards the functioning of the button 9 integrated into the armrest 4, it is noted that this acts on the command key of the gas cylinder which adjusts the height of the support column of the chair. More specifically, the device is similar to that prescribed for the armrest of type 3, with the difference that the button has a single control and the retaining cog 14, 142 is not present. Indeed, the device in question does not need to be bistable, and therefore, when the button 9 is pressed by means of the lever 90, the stay rod 10 is activated, to which is connected the steel cable 13 which activates the valve of the gas cylinder by means of the appropriate device. By releasing the button 9, the command to activate the gas cylinder by means of the cable 5 is not requested, and therefore the desired position is determined.

I claim:

1. An armrest for an office chair, the chair having a seat back and a seat plane, the armrest comprising:

a tubular upright member;

a static support surface connected to an upper end of said upright member;

a first means, positioned at a front end of said support surface, for releasing movement of the seat plane and an inclination of the seat back;

a second means, arranged in side-by-side relationship with said first means at said front end of said support surface, for activating for activating a locking of the seat plane and the inclination of the seat back, said first means comprising:

a control button;

an elastically retracted first lever having an end pivotally mounted at a rear part of said support surface, said elastically retracted first lever having said control button at an opposite end thereof;

a stay rod extending in said support surface in linear co-axial alignment with said upright member, said stay rod longitudinally movable within said support surface;

a guide pin linking said first lever to said stay rod such that a pivoting movement of said first lever causes a corresponding longitudinal movement of said stay rod; and a flexible cable extending through said upright member and connected atone end to said stay rod, said second means comprising:

a second lever having an end pivotally connected in said support surface, said second lever having a retaining cog therein, said retaining cog cooperative with said stay rod so as to retain said stay rod in a fixed position at a point along the longitudinal movement thereof.

2. The armrest of claim 1, said tubular upright member being forwardly inclined, said support surface having a lower surface substantially closed around said upright member, said support surface having an upper side suitable for receiving a forearm thereon, said support surface having a recess at said front end, said control button being housed in said recess.

3. The armrest of claim 1, said flexible cable comprising:

a sheath extending through at least a portion of said upright member; and a control line having an end connected to said stay rod, said control line slidably extending through said sheath.

4. The armrest of claim 1, said stay rod having a series of guide holes linearly aligned in spaced relation to each other.

5. An armrest for an office chair, the chair having a seat back and a seat plane, the armrest comprising:

a tubular upright member;

a static support surface connected to an upper end of said upright member;

a first means, positioned at a front end of said support surface, for releasing movement of the seat plane and an inclination of the seat back;

a second means, arranged in side-by-side relationship with said first means at said front end of said support surface, for activating for activating a locking of the seat plane and the inclination of the seat back, said first means comprising:

a control button;

an elastically retracted first lever having an end pivotally mounted at a rear part of said support surface, said elastically retracted first lever having said control button at an opposite end thereof;

a stay rod extending in said support surface in linear co-axial alignment with said upright member, said stay rod longitudinally movable within said support surface;

a guide pin linking said first lever to said stay rod such that a pivoting movement of said first lever causes a corresponding longitudinal movement of said stay rod; and a flexible cable extending through said upright member and connected at one end to said stay rod, said second means comprising: a second lever having an end pivotally connected in said support surface, said second lever having a retaining cog therein, said retaining cog cooperative with said stay rod so as to retain said stay rod in a fixed position at a point along the longitudinal movement thereof;

a control button positioned at an opposite end of said second lever; and an elastically retracted lever pivotally mounted at a rear part of said support surface, said retaining cog of said second lever having a profile in an upper portion thereof engageable with said retracted lever of said second means.

* * * * *